US009505232B2

(12) United States Patent
Till

(10) Patent No.: US 9,505,232 B2
(45) Date of Patent: Nov. 29, 2016

(54) ROTARY DRIVE ARRANGEMENT FOR A MACHINE FOR PRINTING CONTAINERS

(71) Applicant: Till GmbH, Kelkheim (Taunus) (DE)

(72) Inventor: Volker Till, Hofheim am Taunus (DE)

(73) Assignee: TILL GMBH, Kelkheim (Taunus) (DE)

( * ) Notice: Subject to any disclaimer, the term of this patent is extended or adjusted under 35 U.S.C. 154(b) by 0 days.

(21) Appl. No.: 14/917,578

(22) PCT Filed: Sep. 5, 2014

(86) PCT No.: PCT/EP2014/068909

§ 371 (c)(1),
(2) Date: Mar. 9, 2016

(87) PCT Pub. No.: WO2015/036323

PCT Pub. Date: Mar. 19, 2015

(65) Prior Publication Data

US 2016/0221357 A1 Aug. 4, 2016

(30) Foreign Application Priority Data

Sep. 13, 2013 (DE) ..... 10 2013 015 096

(51) Int. Cl.
*B41J 3/407* (2006.01)

(52) U.S. Cl.
CPC ..... *B41J 3/4073* (2013.01)

(58) Field of Classification Search
None
See application file for complete search history.

(56) References Cited

U.S. PATENT DOCUMENTS

2004/0169690 A1 9/2004 Morton et al.
2011/0273726 A1* 11/2011 Beckhaus ..... B41F 17/18 356/620

FOREIGN PATENT DOCUMENTS

| | | | |
|---|---|---|---|
| CH | 695555 | A5 | 6/2006 |
| DE | 102009058222 | A1 | 6/2011 |
| DE | 102011112281 | B3 | 2/2013 |
| DE | 102011086708 | A1 | 5/2013 |
| EP | 1225053 | A2 | 7/2002 |
| JP | 10278376 | A | 10/1998 |
| WO | WO 2004009360 | A1 | 1/2004 |

* cited by examiner

*Primary Examiner* — Bradley Thies
(74) *Attorney, Agent, or Firm* — Leydig, Voit & Mayer, Ltd.

(57) ABSTRACT

A rotary drive arrangement for a machine for printing containers includes a turntable configured to hold the container to be printed and a format adapter connected to the turntable and configured to transmit a rotational movement to the turntable. A rotary drive is configured to drive the format adapter in rotation about an axis of rotation by means of a transmission element that engages with the format adapter, wherein, in an engagement portion of the transmission element, the format adapter is designed to match an outer periphery of a surface of the container to be printed.

13 Claims, 5 Drawing Sheets

Fig. 1
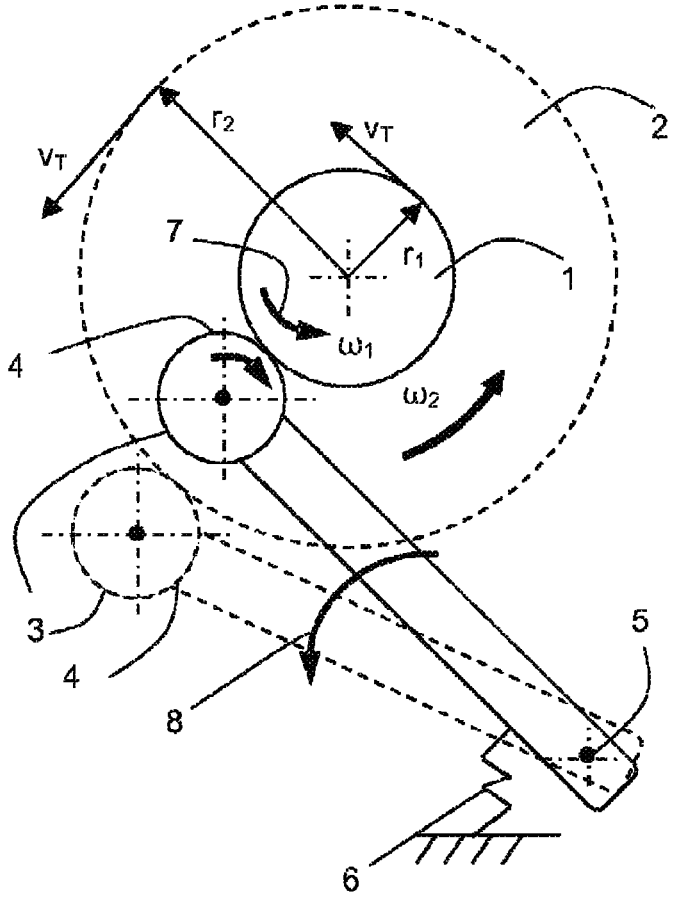
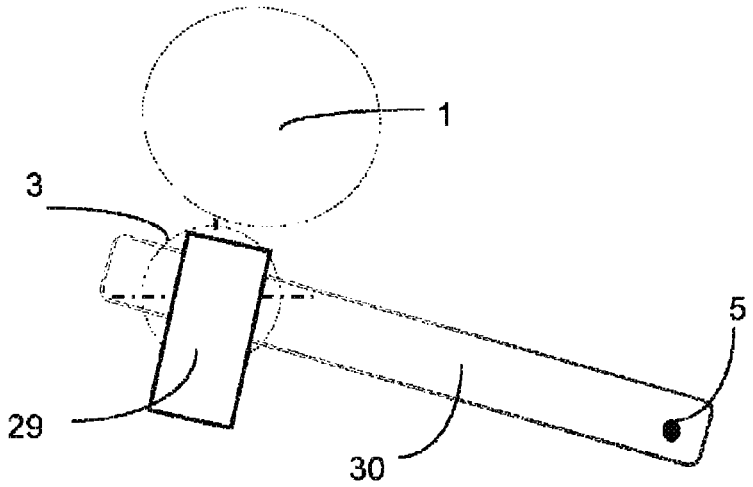
Fig. 1a

ROTARY DRIVE ARRANGEMENT FOR A MACHINE FOR PRINTING CONTAINERS

CROSS-REFERENCE TO PRIOR APPLICATIONS

This application is a U.S. National Stage Application under 35 U.S.C. §371 of International Application No. PCT/EP2014/068909 filed on Sep. 5, 2014, and claims benefit to German Patent Application No. DE 10 2013 015 096.5 filed on Sep. 13, 2013. The International Application was published in German on Mar. 19, 2015 as WO 2015/036323 A1 under PCT Article 21(2).

FIELD

The present invention relates to a rotary drive arrangement for a machine for printing three-dimensional containers, especially for printing the surfaces of said containers on their outer periphery. The containers may in particular be plastic and/or glass bottles. Furthermore, the present invention also relates to a corresponding machine for three-dimensional containers comprising the rotary drive arrangement according to the invention.

BACKGROUND

To ensure that one machine can be used economically for different sizes of containers, bottles, tins or similar items, so-called format adapters are used, which are adapted individually to a wide variety of container shapes and act as adapters between the container and the machine. Depending on the shape of the container, a correspondingly designed format adapter is used to transport the container inside the machine, fix it in position or to align it for printing. Labelling containers such as bottles or other packagings using inkjet printers is known in the art. In such cases, the container to be printed is placed on a turntable in a printing station and centred. The container is then rotated by the turntable. A region of the surface of the container to be printed is then passed by one or more printing heads arranged in the station, which heads print the container by spraying a printing medium from nozzles onto the surface of the container while said container rotates in relation to the printing head. DE 10 2009 058 222 A1, for example, describes a known machine for printing containers in which a container to be printed is placed on a turntable which is rotated about an axis of rotation by a servomotor. A clamping device fixes the container in position before printing commences.

In printing methods such as the drop-on-demand method, the surface of the container to be printed may be printed at a specific maximum droplet sequence frequency depending on the capacity of the respective printing head. In the case of a print image resolution of 360 dpi, the current maximum achievable frequency in the prior art is typically 6000 dots per second. As a result of this limit, the relative speed at which the surface to be printed passes by the printing head is limited. Given the above-mentioned ejection frequency, this results in a maximum relative speed between the printing head and the printing region on the surface of approximately 423.333 mm/s or 60.666 inch/s. A higher relative speed would reduce the quality of the print image.

However, in sectors such as the beverage industry, processing volumes of 36,000 bottles per hour for example are assumed. The throughput when printing the bottles must therefore be correspondingly high, and a high print quality must still be guaranteed at the same time. In order to meet the requirement for a rapid throughput, it is advantageous if the capacity of the printing stations can be fully utilised. In particular, this can be achieved by maintaining the relative speed between the printing surface and the printing head in consideration of the printing head capacity in the region of the maximum relative speed in order to maintain the overall throughput at a high level.

However, consideration must also be given to the fact that, in the case of a body, such as a bottle, rotating about an axis of rotation, the relative speed between the region on the surface of the container to be printed and the printing head is dependent on the distance between the location to be printed on the surface of the three-dimensional container and its axis of rotation.

A wide bottle having a correspondingly large radial extent has a larger peripheral speed than a narrow bottle having a relatively small radial extent at the same rotational speed or angular velocity. The relative rotational speeds at the printing head vary at the same speed or angular velocity.

In order to process containers of different diameters but at the same capacity utilisation rate for the printing head, the appropriate rotational speed or angular velocity must be set for every possible container diameter in order to achieve a peripheral speed in the printing region which is the same and is as high as possible, and in order to achieve a constant relative speed between the printing head and the printing region.

This poses major challenges especially when printing non-rotationally symmetrical container shapes such as elliptical shapes. If such a body rotates about its axis, the distance between the surface to be processed and the axis of rotation changes constantly, as does the peripheral speed of the printing region as it passes the printing head. To achieve a good printing result despite the above issues, the rotational speed would have to be constantly adapted to the ever-changing speed conditions to ensure that the printing region always passes the printing head at the same peripheral speed.

The peripheral speed can be adapted to different container sizes or even to non-rotationally symmetrical container shapes by using controlled servomotors. The controller sets the rotational speed of the turntable to an effective constant relative speed between the surface and the printing head as said turntable passes the printing head.

However, the disadvantage of this solution is that it is comparatively expensive and complex to use servomotors and the appropriate control system. The necessary technology is also correspondingly complex.

SUMMARY

In an embodiment, the present invention provide a rotary drive arrangement for a machine for printing containers. The rotary drive arrangement includes a turntable configured to hold the container to be printed and a format adapter connected to the turntable and configured to transmit a rotational movement to the turntable. A rotary drive is configured to drive the format adapter in rotation about an axis of rotation by a transmission element that engages with the format adapter, wherein, in an engagement portion of the transmission element, the format adapter is configured to match an outer periphery of a surface of the container to be printed.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 1 is a schematic illustration of the principle of maintaining a constant peripheral speed for containers having different diameters, by means of the rotary drive arrangement according to an embodiment of the invention;

FIG. 1*a* is a schematic illustration of a swing arm comprising the element adapted to the format adapter, on which a printing head is fitted;

DETAILED DESCRIPTION

Figure 2A:
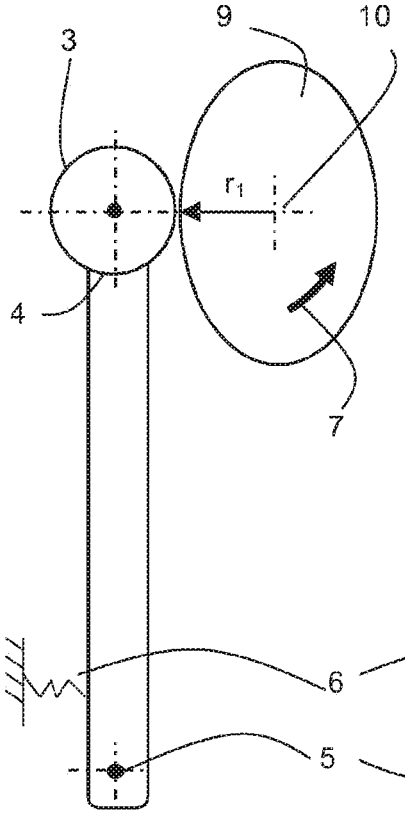
FIGS. 2*a* and 2*b* are schematic illustrations of the principle of maintaining a constant peripheral speed when using non-rotationally symmetrical containers, by means of the rotary drive arrangement according to an embodiment of the invention.

The rotary drive arrangement according to an embodiment of the invention comprises a turntable for holding the container to be printed, a format adapter which is connected to or which can be connected to the turntable for transmitting a rotational movement to the turntable and a rotary drive for driving the format adapter in rotation. The format adapter may be formed in one piece with the turntable or may be rigidly connectable thereto such that a rotational movement of the format adapter about an axis of rotation leads to a rotational movement of the turntable about the axis of rotation at the same angular velocity. The format adapter is driven by means of a force transmission element that engages with the format adapter, said transmission element transmitting the drive force from the rotary drive to the format adapter by positive and/or non-positive means, in which non-positive transmission according to an embodiment of the invention may take place in particular as a result of friction forces from a transmission element in contact with the format adapter, by a positive connection by means of a gear-type gear drive or by electromagnetic forces.

In an embodiment, the present invention provides a simple solution for obtaining a high-quality print image in a simple manner whilst utilising the machine at a high and economical rate.

In an embodiment of the invention, in the engagement portion of the transmission element, the format adapter is designed to match the outer periphery of the surface of the container to be printed. The turntable and the format adapter are aligned such that their axes of rotation coincide in this case. In addition, the turntable is also preferably configured such that, once the container to be printed is placed on the turntable, or in an appropriately configured seat, said turntable is aligned in accordance with the engagement portion of the format adapter for engaging with the transmission element. If, for example, the outer periphery of the container to be printed is circular (as in the case of a bottle), the central axis of the bottle thus coincides with the shared axis of rotation of the turntable and the format adapter. Since the transmission element engages with the format adapter which is adapted to the outer periphery of the body to be printed, in order to rotate the format adapter and thus the turntable comprising the container to be printed, the peripheral rotational speed is always adjusted correctly without the need to adjust or set the angular velocity of the rotary drive, for example, if the shape or size of the container changes. At the same time, the printing station or machine always operates at maximum operating speed. If the shape and/or size of the container to be printed change, it is merely necessary to adjust the format adapter accordingly, said format adapter being designed to be interchangeable according to an embodiment of the invention. The actual rotary drive and the driven transmission element can remain unchanged.

The features according to an embodiment of the invention thus make it possible to operate the rotary drive at a constant rotational speed for different container diameters or different container shapes without the need to regulate the rotational speed accordingly or adjust the rotary drive for different conditions.

In accordance with a preferred embodiment, the format adapter has the same outer shape as the surface to be printed in the engagement portion for engagement with the transmission element and is connected to the turntable in such a way that a seat in the turntable for the container to be printed positions said container in accordance with the outer shape of the format adapter. As a result it is possible to ensure, in a simple technical manner, that the peripheral speed of the surface to be printed automatically remains the same with respect to the printing head even if the outer shape of the container varies, e.g. in the case of an elliptical shape. As a development of the inventive concept, the format adapter may also be designed to be an integral part of the turntable.

According to an embodiment of the invention, the turntable may comprise a seat in the form of a centring aid for the container, making it easier to position the surface of the container to be printed at the correct distance from the printing head and to align it correctly with respect to the format adapter.

In order to implement the rotary drive in a simple manner, a preferred embodiment of the invention provides that the transmission element is guided such that it can move in one plane perpendicular to the axis of rotation of the format adapter (1, 2, 14). For this purpose, the transmission element may in particular be mounted such that it can pivot and/or move in translation. The transmission element is thus always in contact with the format adapter irrespective of the diameter or periphery of said format adapter, i.e. more generally its outer contour. In the case of a format adapter having a small diameter, the transmission portion of the rotary drive is located correspondingly closer to the axis of rotation of the format adapter than in the case of a format adapter having a large diameter.

Since, according to an embodiment of the invention, the transmission element is driven by the rotary drive at a constant speed, the movement is transmitted to the format adapter such that the peripheral speed of the format adapter in the engagement portion between the transmission element and the format adapter is always the same irrespective of the diameter of the format adapter. Since the format adapter is designed to match the outer shape of the container and said container is driven in rotation by the format adapter, a constant peripheral speed is also achieved as it passes the printing head.

If the container is changed, a different format adapter adapted to the container is used which, according to an embodiment of the invention, can be simply fixed to the axis of rotation of the turntable or to the turntable itself such that the container is automatically moved past the printing head at the correct peripheral speed.

An embodiment of the present invention has proved to be particularly advantageous with reference to non-rotationally symmetrically shaped containers. In the case of a container having an elliptical outer shape, for example, and a correspondingly shaped format adapter, the transmission element adapts to the outer shape of the format adapter, said shape corresponding, in the contact region between the transmission element and the format adapter, to the cross-sectional shape of the container in the printing region. This means that, irrespective of the predominant radial extent of the format adapter, which changes constantly, in the contact or engagement portion between the transmission element and the format adapter, the transmission element remains in contact with the format adapter and drives said format adapter in rotation. This leads to a constant peripheral speed in the force transmission region and also in the printing region in the case of an ever-changing angular velocity.

The transmission element may be simply fixed to a swing arm which is mounted about a swivel pin parallel to the axis of rotation of the format adapter. This swing arm is understood to be an arm mounted in rotation about the swivel pin, the transmission element driven by the rotary drive being arranged on said arm at an appropriate distance, preferably at the end of the arm opposite to the swivel pin.

In order to force the transmission element to engage with the format adapter, a preferred embodiment of the invention may provide for the transmission element to be pre-tensioned in the direction of the format adapter or in the direction of the engagement portion on the format adapter, preferably by means of a spring. In the case of a non-rotationally symmetrical body, a spring-loaded swing arm for example may compensate for a pendulum movement as a result of the ever-changing diameter in the contact region between the transmission element and the format adapter and transmit the rotational movement of the transmission element by positive and/or non-positive means to the format adapter.

An advantageous embodiment provides for the transmission between the transmission element and the format adapter to be achieved by positive means. For this purpose, the transmission element may be configured as a gear wheel, which is designed to engage in or engages in peripheral teeth on the format adapter. The force can thus be transmitted in the manner of a gear coupling or a rolling gear and a preferred embodiment provides that the transmission element be a drive pinion which interlocks with a correspondingly toothed format adapter. The teeth on the format adapter are preferably distributed evenly over the periphery of said format adapter. This type of drive mechanism has the particular advantage of ruling out slippage in transmission.

In a further advantageous embodiment of the invention it is provided for the force to be transmitted between the transmission element and the format adapter by non-positive means. In such an embodiment, the transmission element may in particular be configured as a friction drive engaging on an opposite face of the format adapter, as a rubberised wheel, for example. In the case of a non-positive drive mechanism of this kind, it is thus provided for the rotational movement of the transmission element to be transmitted by means of a friction coupling, where non-positive surface contact may be achieved via the peripheral surfaces of the format adapter and transmission element respectively, which surfaces transmit the drive force in a similar way to a friction gear. The peripheral surfaces may of course have different shapes. Thus, for example, flat, conical or curved contact surfaces are feasible.

According to a further embodiment, the transmission element may be configured as electromagnetic coils that interact with magnets attached to the format adapter for force transmission purposes, i.e. forming an electric motor. As soon as current passes through the coils, a magnetic field is formed in a manner known per se, in which field the magnets arranged on the format adapter are attracted or repelled. A rotational movement is transmitted to the format adapter as a result.

The drive force is transmitted on the basis of the electromagnetic fields which are generated by electrical means and lead to magnetic forces as a result of induction. Applying a constant voltage to the coil also achieves a proportional rotational speed of the format adapter. This embodiment of the invention has the particular advantage of minimising wear in force transmission.

In order to achieve an even peripheral speed it can be provided, in a simple manner, for the magnets to be attached to the format adapter along the contour of the surface to be printed, preferably at equidistant intervals, i.e. evenly distributed. In addition, the position of the coil in relation to the axis of rotation of the format adapter can be varied, the distance from the axis of rotation being adapted to the radial extent of the format adapter. The coil can thus always be adapted to the radial position of the magnets, even if a different shape of format adapter is used. In order to adapt to the size or contour of the surface to be printed, the coil can, for example, be moved by rollers running along a suitably shaped guide surface on the format adapter, similar to the friction drive described above, with the difference that the rollers are not responsible for the drive mechanism.

The rotary drive arrangement preferably comprises an encoder which is designed in such a way as to detect the angular position of the rotary drive and issue signals for controlling the printing heads. This ensures that the correct printing region is opposite the printing head when said printing head sprays ink onto the container.

In another embodiment, the present invention provides a machine for printing three-dimensional containers, such as bottles, comprising at least one rotary drive arrangement according to the invention.

According to an embodiment of the invention, it is also proposed that at least one printing head or a plurality of printing heads should be fitted on the swing arm of the transmission element. Moreover, according to an embodiment of the invention, it is also possible to fit at least one printing head or a plurality of printing heads on one or more additional swing arms, on each of which an element corresponding to the transmission element is fixed such that it can rotate, but without a drive mechanism, and thus follows the contour of the format adapter which rotates as the container itself rotates.

As a swing arm comprising the printing head or printing heads follows the contour of the container to be printed by means of the format adapter, the printing head or printing heads are automatically always in the correct position and at the correct distance from the surface to be printed. As, according to an embodiment of the invention, the printing head or printing heads are arranged such that they can print on the surface of the container, arranging printing heads on the single driven swing arm and/or one or more non-driven swing arms is a simple means of ensuring multi-colour printing even on containers of different diameters, without the need for further control or regulation devices.

In this case, it is particularly advantageous if attachments can be fitted to the swing arms, which attachments rotate the printing head itself in such a way that the surface of the printing head comprising the printing nozzles is always arranged at a tangent to the surface of the container to be printed. This can be achieved by means of a suitable cam control, for example.

In FIG. 1, a format adapter 1 is shown as part of a rotary drive arrangement according to an embodiment of the invention, said format adapter being designed to match the outer shape of a container to be printed. In this case, according to an embodiment of the invention, matching means that the format adapter 1 corresponds to the body to be printed in respect of both contour and size. In the illustration shown in FIG. 1, the format adapter 1 has a circular cross section and is constructed in the form of a cylinder. Accordingly, the container may be a bottle which also has a cylindrical shape in the region of the bottle body as the surface to be printed. The format adapter 1 thus has a rotationally symmetrical cross section having a radius $r_1$.

The dotted lines illustrate a second format adapter 2 which is also rotationally symmetrical and which is adapted to a large container, also to a rotationally symmetrical container having a larger cross section. The second format adapter 2 has a radius $r_2$.

A transmission element 3 serving as the drive for the format adapter 1, 2 is driven clockwise 4 in rotation by a rotary drive. The transmission element 3 is mounted by means of a mounting 5 such that it can swivel in the manner of a swing arm and is pressed by means of a spring 6 such that it engages with the outer periphery of the format adapter 1, 2. In this way, the transmission element 4 transmits the rotary force onto the format adapter 1 in the manner of a gear or friction drive, as a result of which the format adapter 1 rotates counterclockwise 7.

By replacing the format adapter 1 with the format adapter 2, the rotary drive adapts easily to the different size conditions of the format adapter 1, 2 and thus to the container to be printed, the dimensions of said container being represented by the format adapter 1, 2. Due to the swivel mounting 5 of the transmission element 3, the transmission element 3 executes a pivoting movement 8 and comes into contact with the outer periphery of the larger format adapter 2.

If the drive of the transmission element 3 now rotates in the same direction of rotation and at the same rotational speed or angular velocity as was the case for the smaller format adapter 1, the same rotational movement is transmitted to the outer periphery of the format adapter 2. As the format adapter 2 has a larger radius $r_2$ than the smaller format adapter of radius $r_1$, the angular velocity $\omega_2$ is also less than the angular velocity $\omega_1$ of the smaller format adapter 1. Nevertheless, both format adapters 1 and 2 have the same peripheral speed or tangential speed $v_T$. This ensures that the relative speed between the region to be printed on the container and a printing head is always the same irrespective of the size of the container.

The drive is thus independent of the size of the container. This is particularly due to the fact that the format adapter 1, 2 maps the contour of the region of the container to be printed and the transmission element 3 transmits the rotational movement along this contour.

As shown in FIG. 1*a*, this concept can also be used to arrange one (or more) printing head(s) 29 on the swing arm 30, on which the transmission element 3 or an element corresponding to the transmission element 3 is fixed, said element following the contour of the format adapter 1. The printing head 29 is thus automatically always in the correct position and at the correct distance from the surface of the container 12 to be printed.

Figure 2B:
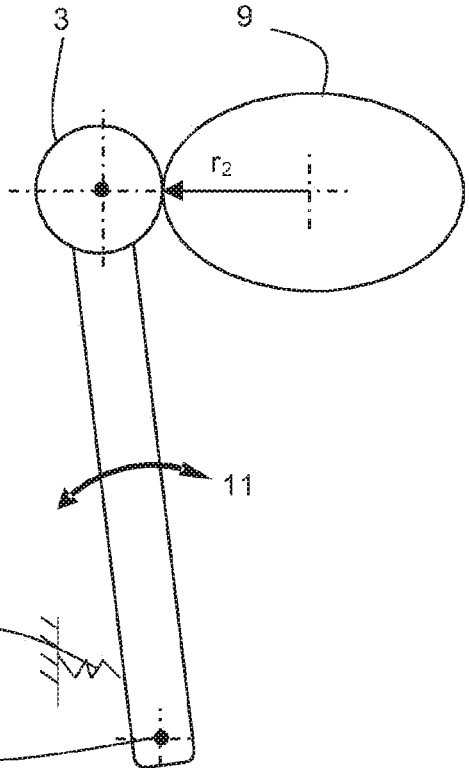

This principle also applies to non-rotationally symmetrical containers and correspondingly adapted format adapters 9, as shown in FIGS. 2*a* and 2*b*. The format adapter 9 illustrated in FIGS. 2*a* and 2*b* has a non-rotationally symmetrical (elliptical) cross section. In accordance with the arrangement in FIG. 1, the transmission element 3 is pushed pivotably by means of the spring 6 and the mounting 5 in the manner of a swing against the format adapter 9 and thus rotates in a clockwise direction 4. This movement is transmitted to the format adapter 9 which rotates counterclockwise 7 about its axis of rotation 10.

The arrangement shown in FIGS. 2*a* and 2*b* is achieved in a simple manner by replacing the format adapter 1, 2 with the format adapter 9. Otherwise, the rotary drive arrangement is the same.

FIG. 2*a* shows the format adapter 9 in a first position in which the transmission element 3 is in contact with the format adapter 9 in its narrow region having the (small) radius $r_1$. FIG. 2*b* shows the format adapter 9 after it has rotated counterclockwise through 90°. Having the radius of $r_2$, the extent of the radial extension in the contact region between the transmission element 3 and the format adapter 9 is now larger than in FIG. 2*a*.

The distance between the transmission element 3 and the axis of rotation 10 of the format adapter 9 also varies due to the mounting 5 and the spring 6. If the format adapter 9 continues to rotate, the spring-loaded transmission element 3 executes a pendulum movement 11, since it adapts constantly to the changing diameter of the format adapter 9.

As the peripheral speed of the transmission element 3 remains constant irrespective of its position with respect to the axis of rotation 10 of the format adapter 9, the format adapter 9 has a constant peripheral speed, with an ever-changing radius, in the contact region between the transmission element 3 and the format adapter 9. The peripheral speed of even a non-rotationally symmetrical container, having a shape corresponding to the contour of the format adapter 9, is automatically kept constant in this manner.

Figure 3:
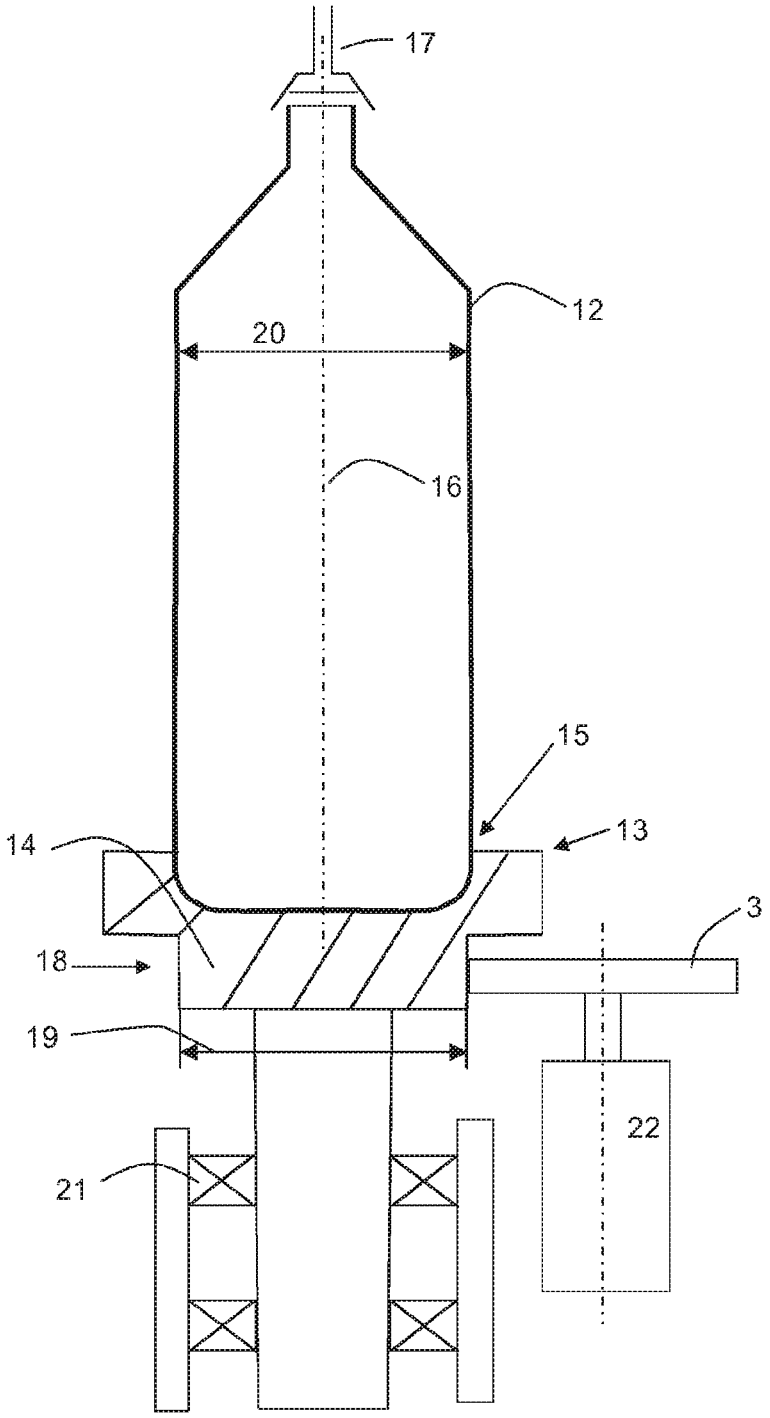
FIG. 3 is a sectional view of a rotary drive arrangement according to the invention in accordance with a first embodiment of the invention.

FIG. 3 is a side view of the rotary drive arrangement according to an embodiment of the invention, the concept behind said arrangement already having been explained with reference to FIGS. 1 and 2. A container to be printed in the form of a bottle 12 is arranged on a turntable 13, which is configured as an integral part of or as one piece with a format adapter 14 adapted to the bottle 12, a seat 15 simultaneously ensuring that the bottle 12 is centred from beneath with respect to an axis of rotation 16 and aligning the contour of the bottle 12 with the contour of the format adapter 14. A centring aid 17 that is arranged above the bottle 13 and can be displaced along the axis of rotation 16 is also used to position and guide the bottle 12 in the rotary drive arrangement shown.

The format adapter 14 has a region 18 located beneath the seat 15 of the turntable 13, said region serving for engagement with the transmission element 3. The format adapter 14 has a rotationally symmetrical design in relation to the axis of rotation 16, the engagement portion 18 extending over the periphery of the format adapter 14. The diameter 19 of the format adapter 14 in the engagement portion 18 is adapted to the diameter 20 of the bottle 12 in a printing region, the diameter 19 of the format adapter 14 being the same size as the diameter 20 of the bottle 12 in the printing region. The periphery of the format adapter 14 in the engagement portion 18 thus corresponds to the periphery of the container 12 in the region to be printed.

The format adapter 14 is mounted by means of a mounting 21 such that it can rotate about the axis of rotation 16. A torque motor 22 is connected to the transmission element 3 such that the transmission element 3 rotates at the speed of the torque motor 22. The transmission element 3 transmits its rotational movement to the format adapter 14 in the engagement portion 18, although the type of force transmission is not illustrated here.

This may inter alia be force transmission by positive or non-positive means. The format adapter 14 in turn transmits the rotational movement via the seat 15 in the turntable 13 to the bottle 12 so that said bottle also rotates about the axis of rotation 16. The peripheral speed of the bottle 12 in the printing region corresponds to the peripheral speed of the format adapter 14 in the engagement portion 18.

If a bottle having a smaller diameter now needs to be printed based on the configuration illustrated in FIG. 3, a format adapter adapted to such a bottle is used with a corresponding engagement portion having a smaller diameter. The transmission element 3 adapts to the different format adapter in such a case, moves closer to the axis of rotation 16 and transmits its rotational movement to the corresponding format adapter at the same rotational speed as in FIG. 3. As a result of this transmission, the peripheral speed in the printing region is exactly the same as the peripheral speed in the printing region of the bottle 12 illustrated in FIG. 3.

Figure 4:
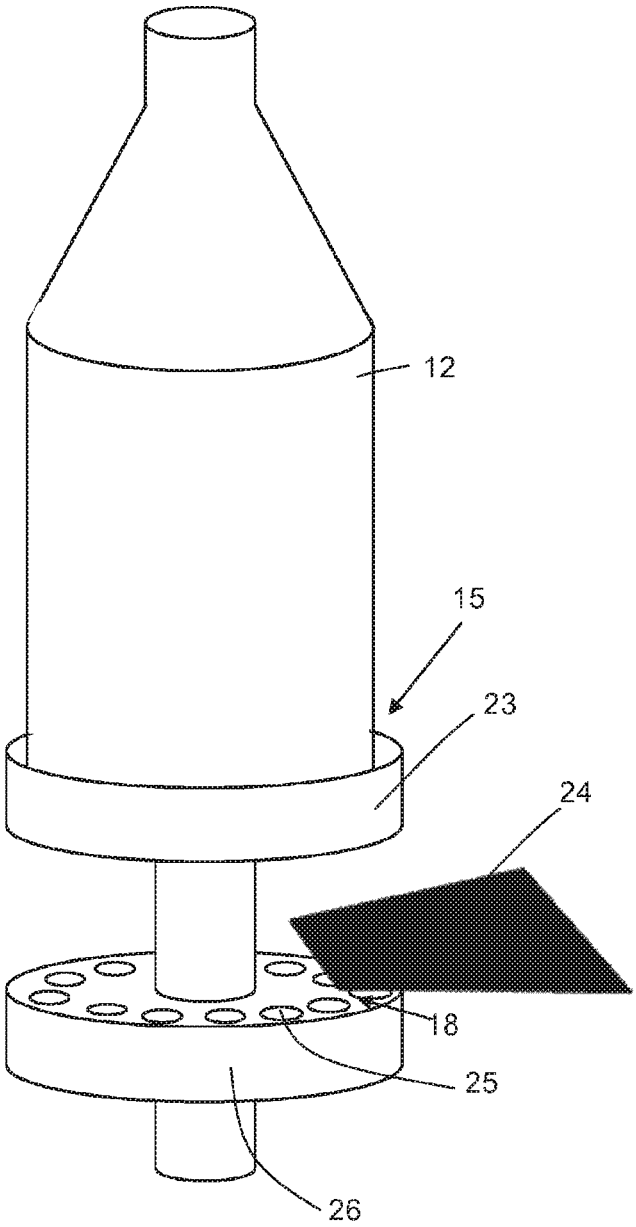
FIG. 4 is a perspective view of a rotary drive arrangement according to the invention in accordance with a further embodiment of the invention.

FIG. 4 also shows a bottle 12 inserted in the seat 15 in a turntable 23 which is connected to the format adapter 26. Unlike in FIG. 3, the drive and the transmission element are formed by a coil 24 through which current passes (or even a plurality of coils) as a rotary drive and a plurality of magnets 25 distributed evenly over the periphery of the format adapter 26 as a transmission element. According to an embodiment of the invention, the magnets 25 are arranged such that the course of the magnets 25 corresponds to the contour of the bottle 12 in the region to be printed. The arrangement of the magnets 25 on the format adapter 26 thus corresponds to the engagement portion 28.

The coil 25 comprises conductors through which current passes, said conductors, in conjunction with the magnets 25, forming an electric motor in a manner known per se, the operating principle of which motor does not need to be explained further at this juncture.

Figure 5:
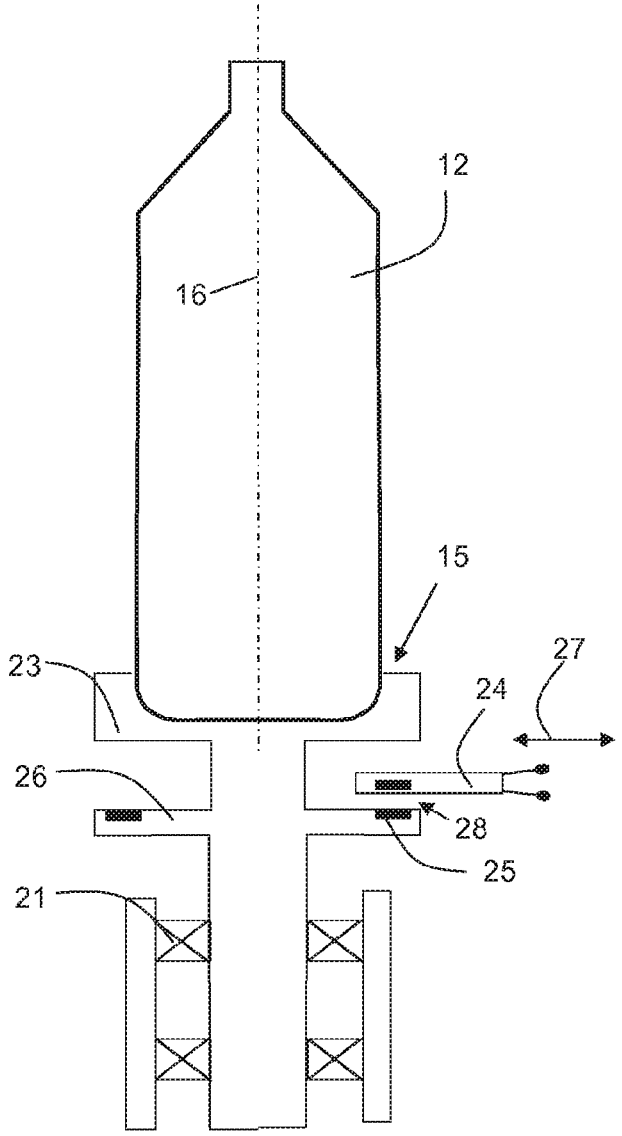
FIG. 5 is a sectional view of the rotary drive arrangement from FIG. 4.

FIG. 5 is a sectional view through this rotary drive arrangement. The turntable 23 comprises a centring seat 15 and is also connected to the format adapter 26, beneath which the turntable 23 comprising the format adapter 23 is mounted in the mounting 21, so that the turntable 23 and format adapter 26, formed integrally or as one piece, can rotate together with the bottle 12 about the axis of rotation 16. The magnets 25 are arranged in a region of the format adapter 26 extending radially outwards and follow the contour of the bottle 12.

The coil 24 is arranged above the magnets 25 in a contactless manner. The drive force is transmitted on the basis of the electromagnetic fields which are generated by electrical means and lead to magnetic forces as a result of induction. If a voltage is applied to the coil, this results in an electromagnetic field which causes magnetic forces and drives the format adapter 23 and thus the bottle 12 in rotation.

If a smaller or larger format adapter is used—suitable for a smaller or larger bottle—the magnets 25 also lie on a correspondingly larger periphery. The coil can be moved in relation to the axis of rotation 16, in a similar manner to that illustrated in FIGS. 1 and 2, for example, and may be adapted to the radial position of the magnets 25.

Applying a constant voltage to the coil 24 also achieves a proportional rotational speed of the format adapter 26 that defines the peripheral speed of the bottle in the region to be printed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 format adapter for small container
2 format adapter for large container
3 transmission element
4 direction of rotation of the transmission element
5 mounting, swivel pin
6 spring
7 direction of rotation of the format adapter
8 pivoting movement of the transmission element
9 non-rotationally symmetrical format adapter
10 axis of rotation of the format adapter
11 pendulum movement
12 container, bottle
13 turntable
14 format adapter
15 seat
16 axis of rotation
17 centring aid
18 engagement portion
19 diameter of the engagement portion
20 diameter of the bottle in the printing region
21 mounting
22 rotary drive, torque motor
23 turntable
24 coil, rotary drive, transmission element
25 magnet, transmission element
26 format adapter
27 coil mobility

28 engagement portion
29 printing head
30 swing arm

The invention claimed is:

1. A rotary drive arrangement for a machine for printing containers, the rotary device arrangement comprising:

a turntable configured to hold the container to be printed, a format adapter connected to the turntable and configured to transmit a rotational movement to the turntable, and a rotary drive configured to drive the format adapter in rotation about an axis of rotation by a transmission element that engages with the format adapter, wherein, in an engagement portion of the transmission element, the format adapter is configured to match an outer periphery of a surface of the container to be printed.

2. The rotary drive arrangement according to claim 1, wherein, in the engagement portion of the transmission element, the format adapter has a same outer shape as the surface to be printed and is connected to the turntable in such a way that a seat in the turntable for the container to be printed positions the container in accordance with the outer shape of the format adapter.

3. The rotary drive arrangement according to claim 1, wherein the transmission element is guided such that it is moveable in one plane perpendicular to the axis of rotation of the format adapter.

4. The rotary drive arrangement according to claim 3, wherein the transmission element is fixed to a swing arm, which is mounted about a swivel pin parallel to the axis of rotation of the format adapter.

5. The rotary drive arrangement according to claim 1, wherein the transmission element is pre-tensioned in a direction of the engagement portion on the format adapter.

6. The rotary drive arrangement according to claim 1, wherein the transmission element is configured as a gear wheel, which is designed to engage in peripheral teeth of the format adapter.

7. The rotary drive arrangement according to claim 1, wherein the transmission element is configured as a friction drive engaging on an opposite face of the format adapter.

8. The rotary drive arrangement according to claim 1, wherein the transmission element is configured as an electromagnetic coil that interacts with magnets attached to the format adapter for force transmission purposes.

9. The rotary drive arrangement according to claim 8, further comprising magnets attached to the format adapter along the contour of the surface to be printed.

10. The rotary drive arrangement according to claim 1, further comprising an encoder configured to detect an angular position of the rotary drive arrangement and issue position signals for controlling printing heads.

11. The rotary drive arrangement according to claim 1, further comprising at least one printing head is arranged on a swing arm, on which the transmission element or a corresponding non-driven element in a periphery of the transmission element is fixed, the element lying against the format adapter and following a contour of the rotating format adapter, such that the surface of the container is printable by the at least one printing head.

12. The rotary drive arrangement according to claim 11, further comprising attachments that are fittable and that are configured to rotate the at least one printing head itself in such a way that a surface of the printing head comprising printing nozzles is always arranged at a tangent to the surface of the container to be printed.

13. A machine for printing three-dimensional containers comprising: at least one rotary drive arrangement comprising:

a turntable configured to hold a container to be printed, a format adapter connected to the turntable and configured to transmit a rotational movement to the turntable, and a rotary drive configured to drive the format adapter in rotation about an axis of rotation by means of a transmission element that engages with the format adapter, wherein, in an engagement portion of the transmission element, the format adapter is designed to match an outer periphery of a surface of the container to be printed.

* * * * *